US009892588B2

(12) United States Patent
Jadeja

(10) Patent No.: US 9,892,588 B2
(45) Date of Patent: Feb. 13, 2018

(54) APPARATUS AND METHOD FOR GAMING

(75) Inventor: Rajendrasinh Jadeja, Las Vegas, NV (US)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 816 days.

(21) Appl. No.: 12/569,244

(22) Filed: Sep. 29, 2009

(65) Prior Publication Data

US 2011/0077070 A1 Mar. 31, 2011

(51) Int. Cl.
*G07F 17/32* (2006.01)

(52) U.S. Cl.
CPC ..... *G07F 17/3218* (2013.01); *G07F 17/3211* (2013.01); *G07F 17/3244* (2013.01)

(58) Field of Classification Search
CPC ..... G07F 17/321; G07F 17/3244; G07F 17/3218; G07F 17/3211; G07F 17/34; G07F 17/32
USPC ..... 463/25, 30–34
See application file for complete search history.

(56) References Cited

U.S. PATENT DOCUMENTS 4,856,787 A * 8/1989 Itkis ..... 273/237
6,135,884 A * 10/2000 Hedrick et al. ..... 463/20
6,219,836 B1 * 4/2001 Wells ..... G07F 17/32 463/25
6,315,666 B1 * 11/2001 Mastera ..... G07F 17/3211 463/20
6,656,041 B1 12/2003 Kaminkow et al.
6,814,666 B2 11/2004 Borg
7,033,272 B1 * 4/2006 Mason ..... 463/25
7,056,215 B1 * 6/2006 Olive ..... 463/27
7,059,968 B2 6/2006 Borg
7,311,598 B2 12/2007 Kaminkow et al.
7,311,604 B2 12/2007 Kaminkow et al.
D562,912 S 2/2008 Myers
7,515,718 B2 * 4/2009 Nguyen et al. ..... 380/278
7,854,654 B2 * 12/2010 Baerlocher et al. ..... 463/27
2004/0018879 A1 1/2004 Borg
2004/0029641 A1 2/2004 Borg
2004/0229693 A1 11/2004 Lind et al.
2004/0248642 A1 * 12/2004 Rothschild ..... 463/20
2005/0020348 A1 * 1/2005 Thomas ..... G07F 17/3211 463/20
2005/0085300 A1 * 4/2005 Johnson ..... G07F 17/32 463/42
2005/0192099 A1 * 9/2005 Nguyen et al. ..... 463/42
2005/0215325 A1 * 9/2005 Nguyen et al. ..... 463/46
2006/0040732 A1 * 2/2006 Baerlocher et al. ..... 463/25
2006/0058100 A1 * 3/2006 Pacey ..... G07F 17/3211 463/31
2007/0077981 A1 * 4/2007 Hungate et al. ..... 463/16
(Continued)

FOREIGN PATENT DOCUMENTS

AU 2005282887 3/2006
AU 2005220258 6/2006
(Continued)

*Primary Examiner* — Jasson Yoo
(74) *Attorney, Agent, or Firm* — Armstrong Teasdale LLP

(57) ABSTRACT

A display apparatus for a gaming system comprises a display unit arranged to be mounted to an Electronic Gaming Machine (EGM). Display circuitry is arranged to control the display unit, the display circuitry being arranged to communicate with an EGM controller to display information under a control of the EGM controller.

7 Claims, 7 Drawing Sheets

(56) References Cited

U.S. PATENT DOCUMENTS

| | | | | |
|---|---|---|---|---|
| 2007/0077984 | A1* | 4/2007 | Aida | G07F 17/32 463/20 |
| 2007/0113442 | A1 | 5/2007 | Barrie | |
| 2007/0178958 | A1* | 8/2007 | Inamura | G07F 17/32 463/17 |
| 2007/0284814 | A1 | 12/2007 | Hirato et al. | |
| 2007/0287527 | A1 | 12/2007 | Tanabe et al. | |
| 2007/0287528 | A1 | 12/2007 | Hirato et al. | |
| 2008/0020817 | A1 | 1/2008 | Kaminkow et al. | |
| 2008/0020842 | A1 | 1/2008 | Kaminkow et al. | |
| 2008/0051168 | A1 | 2/2008 | Kaminkow et al. | |
| 2008/0108433 | A1* | 5/2008 | DiMichele et al. | 463/40 |
| 2008/0113794 | A1 | 5/2008 | Cole | |
| 2008/0182657 | A1* | 7/2008 | Bennett et al. | 463/27 |
| 2009/0005142 | A1* | 1/2009 | Yang | G07F 17/32 463/13 |
| 2010/0087259 | A1* | 4/2010 | Johnson | G07F 17/3216 463/46 |

FOREIGN PATENT DOCUMENTS

| | | | |
|---|---|---|---|
| AU | 2006201077 | | 3/2007 |
| AU | 2007202647 | | 1/2008 |
| AU | 2007202648 | | 1/2008 |
| AU | 2007202651 | | 1/2008 |
| EP | 0896308 | A1 | 2/1999 |
| EP | 0896308 | B1 | 10/2003 |
| EP | 1529558 | A1 | 5/2005 |
| EP | 1529558 | B1 | 1/2007 |
| EP | 1529558 | B8 | 4/2007 |
| EP | 1865474 | A1 | 12/2007 |
| EP | 0896308 | B2 | 2/2009 |
| JP | 2005118495 | A | 5/2005 |
| JP | 2005245687 | A | 9/2005 |
| WO | 2006028740 | | 3/2006 |

* cited by examiner

APPARATUS AND METHOD FOR GAMING

RELATED APPLICATIONS

This application claims priority to U.S. Provisional Patent Application No. 60/100,927 having a filing date of Sep. 29, 2008, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to an apparatus and method for gaming and, particularly, but not exclusively, to an apparatus and method for displaying gaming related information.

Gaming is implemented by many types of gaming systems, providing many different types of games. These include traditional type casino games, such as roulette, Keno, bingo and many others, all of which may nowadays be implemented in electronic form (in many cases utilising video display screens). These also include gaming systems which comprise a game controller arranged to control the random display of several symbols from a pre-determined set of symbols and to determine a game outcome such as a game win, based on the displayed symbols. Such gaming systems may commonly be implemented as a stepper machine provided with reels, with each reel carrying several symbols of the set, or a video machine wherein selected symbols are displayed on virtual reels in a graphical display device. Win outcomes can occur based on symbols appearing on one or more horizontal lines, diagonal lines, or in any other pre-determined way.

Known gaming systems and gaming machines (such as Electronic Gaming Machines, "EGMs"), use various lighting and sound effects to attract, stimulate and entertain players, and also to provide information on progression of a game, which may be an individual game played on the machine or a linked game played by several players. Separate displays may be provided for displaying different information on different games, advertising or other information. The provision of separate displays or displays which provide different gaming and advertising information from the "main" game played on the machine, may require construction of expensive apparatus, particularly where the displays are implemented in an EGM.

In some gaming apparatus, such as EGMs, a "main" display may be provided for displaying aspects of a main game, for example symbol selection games such as discussed above, and a secondary display, usually mounted above the main display in a "top box", may be provided to display other information. The other information may include information on other games, such as games played on the EGM, progressive jackpot levels, and/or various illuminated or video artwork associated with the EGM.

These secondary displays are part of the EGM and therefore add to the expense of the EGM. They are designed specifically to operate within and as part of the EGM.

It is known to provide "toppers" which are separate displays units that may be mounted to an EGM. Commonly, toppers merely display artwork (which may be illuminated) associated with the EGM or are driven by another device, such as a jackpot controller, for example, to show the progression of a linked jackpot. These toppers are usually machine specific. That is, they are designed for particular EGM, or a particular linked game. Typically these toppers are in the form of backlit printed glass bearing the name of the game. Inasmuch as the printed glass is a fixed medium, the toppers have been designed to identify the game to players from a distance so the players can find the game among other games on the casino floor.

BRIEF SUMMARY OF THE INVENTION

In accordance with a first aspect, the present invention provides a display apparatus for a gaming system, comprising a display unit arranged to be mounted to an Electronic Gaming Machine (EGM), and display circuitry arranged to control the display unit, the display circuitry being arranged to communicate with an EGM controller to display information under a control of the EGM controller.

In an embodiment, the display circuitry includes a display controller, arranged to communicate with or be controlled by the EGM controller. In an embodiment, the display controller may comprise a processor for intelligently controlling the display unit.

In an embodiment, the display circuitry is arranged to communicate to communication with an external device to display information under control of the external device. The external device may be a server of a gaming establishment arranged to control the display unit to display information desired by the gaming establishment (e.g. Casino). It may be a jackpot controller (JPC) arranged to control the display to display information about a jackpot, such as a linked jackpot. It may be any other external device. In an embodiment, the display circuitry is selectively arranged to communicate with the external device and the EGM to display information under control of either or both the external device and EGM. Where the display circuitry includes a display controller, the controller may be arranged to communicate with or be controlled by the EGM controller and/or an external device.

In an embodiment, the display circuitry is arranged to enable communication with any one of a plurality of different EGMs, so that it may display information under the control of any of the plurality of EGMs. The display unit may be mountable to one of several different EGMs which are arranged to play different games, and display information relating to that particular game, for example. The display unit may be generic, and able to be used with different EGMs.

In an embodiment, the display apparatus is arranged to be used with a configurable EGM. A configurable EGM is one which can be configured to play different games. For example, different software may be downloaded to the configurable EGM to enable it to play different games. The software may be downloaded from a remote server over a network. The display circuitry is responsive to the configurable EGM to display information associated with the particular software that has been downloaded, for example, the particular game that has been downloaded.

In an embodiment, the display apparatus comprises a housing mounting the display unit and display circuitry. The housing is arranged to be mounted to an EGM. In an embodiment, the housing forms a "topper" arranged to be mounted to the top of an EGM to provide a further display.

In an embodiment, the housing may be selectively mounted to different types of EGMs, for example EGMs playing different games.

In an embodiment, the display circuitry is arranged to communicate wirelessly with an EGM and/or external device.

It is an advantage of at least an embodiment of the invention to provide a versatile display device positioned on the EGM as a topper which can be selectively mounted to different types of EGMs and which can be controlled by the EGM and/or external devices, such as, for example, casinos servers, to display gaming related information. The information may include information on a game being played on the EGM, advertising information, other promotional information provided on behalf of the casino, or generally any information that it is required to present. In an embodiment, the invention also has the advantage that provision of the display apparatus economises on costs of EGMs. The display apparatus, in an embodiment, is effectively a generic displayer which can be attached to different types of EGMs. This can therefore take the place of displays which would otherwise have to be particularly designed for an EGM.

It is an advantage of at least an embodiment of the invention where the display apparatus includes a controller, such as a processor, that the display apparatus is intelligent and can be programmed with appropriate software or controlled by external devices/EGMs to operate in accordance with control instructions. This provides versatility.

In accordance with a second aspect, the present invention provides a method of displaying information for a gaming system, the method comprising the steps of configuring a controller of the display apparatus to communicate with an EGM in order for the display apparatus to display information provided by the EGM.

In an embodiment, the method comprises the further step of configuring the controller to communicate with an external device, such as casino server.

In accordance with a third aspect, the present invention provides a computer programme, providing instructions for controlling a processor to implement a method in accordance with the second aspect of the invention.

In accordance with a fourth aspect, the present invention provides a computer readable medium providing a computer programme in accordance with the third aspect of the invention.

In accordance with a fifth aspect, the present invention provides a data signal providing a computer programme in accordance with the third aspect of the invention.

In accordance with a sixth aspect, the present invention provides a display apparatus for a gaming system, the display apparatus comprising a display unit arranged to be mounted to an Electronic Gaming Machine (EGM) which is arranged to receive downloadable software for changing the operation of the EGM, the display unit being arranged to change displays in response to the changed operation of the EGM.

In accordance with a seventh aspect, the present invention provides a method of displaying information for a gaming system, the method comprising the steps of configuring a controller of the display apparatus to be controlled by downloadable software for a downloadable EGM, in order for the display apparatus to display information in accordance with the downloadable software.

In accordance with an eighth aspect, the present invention provides a computer programme comprising instructions for controlling a processor to implement a method in accordance with the seventh aspect of the invention.

In accordance with a ninth aspect, the present invention provides a computer readable medium, providing a programme in accordance with the eighth aspect.

In accordance with a tenth aspect, the present invention provides a data signal, providing a computer programme in accordance with the eighth aspect of the invention.

In accordance with an eleventh aspect, the present invention provides a display apparatus for a gaming system, comprising a display unit mountable to an Electronic Gaming Machine (EGM), and being arranged to be selectively controlled by an EGM controller to display information under control of the EGM controller, and an external device, to display information under the control of the external device.

In an embodiment, the external device may be a gaming server, such as a Casino server.

In accordance with a twelfth aspect, the present invention provides a method of displaying information for a gaming system, the method comprising the steps of configuring a controller of a display apparatus to selectively communicate with an EGM in order for the display apparatus to display information provided by the EGM, and an external device in order for the display apparatus to display information provided by the external device.

In accordance with a thirteenth aspect, the present invention provides a computer programme including instructions for controlling a processor to implement a method in accordance with the eleventh aspect of the invention.

In accordance with a fourteenth aspect, the present invention provides a computer readable medium providing a computer programme in accordance with the thirteenth aspect of the invention.

In accordance with a fifteenth aspect, the present invention provides a data signal providing a computer programme in accordance with the thirteenth aspect of the invention.

BRIEF DESCRIPTION OF SEVERAL VIEWS OF THE DRAWINGS

Features and advantages of the present invention will become apparent from the following description of embodiments thereof, by way of example only, with reference to the accompanying drawings, in which.

DETAILED DESCRIPTION OF THE INVENTION

Figure 1:
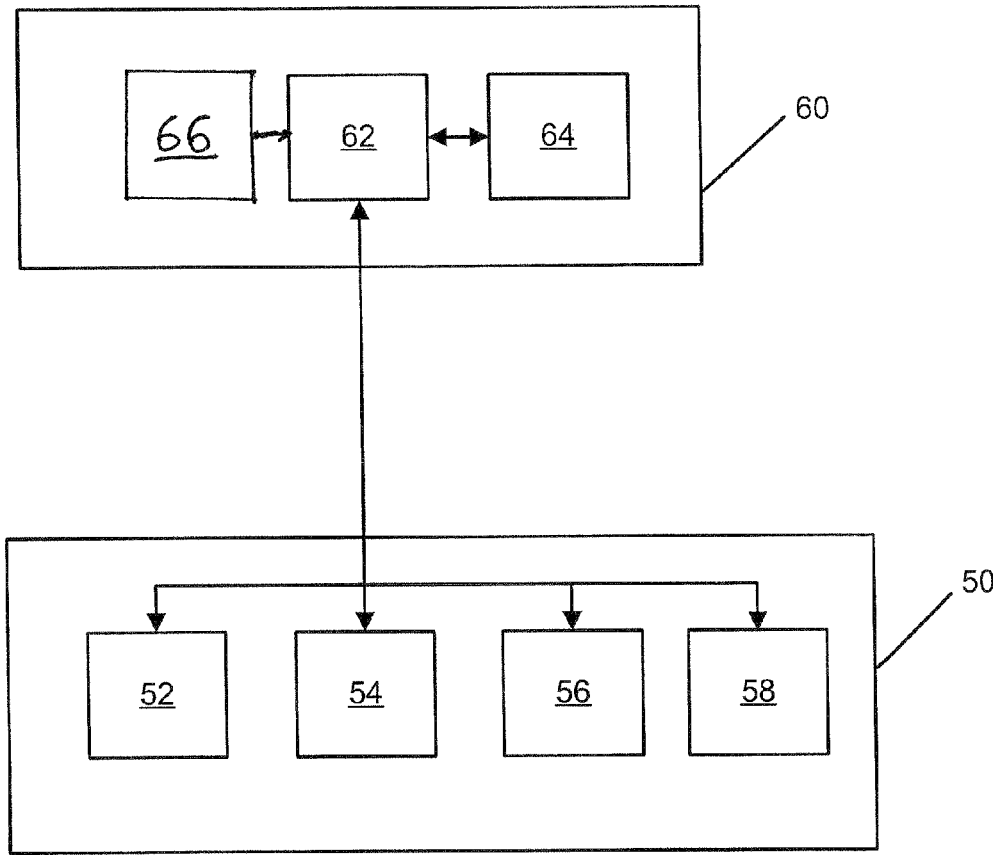
FIG. 1 is a block diagram of the components of a gaming system.

Referring to the drawings, there is shown a gaming system, which in this embodiment includes an Electronic Gaming Machine (reference numeral 10, FIG. 2) and a display apparatus (reference numeral 40, FIG. 2 and also other forms which will be described later on with reference to other drawings) in accordance with an embodiment of the present invention.

In this embodiment, the display apparatus 40 is arranged to be mounted to the EGM and comprises display circuitry arranged to control a display, the display circuitry being arranged to communicate with the EGM controller to display information under the control of the EGM controller. The display apparatus 40 may be selectively connected to different EGMs and, in this embodiment, is generic, so that it can be controlled by different EGMs which may, for example, provide different games.

Figure 2:
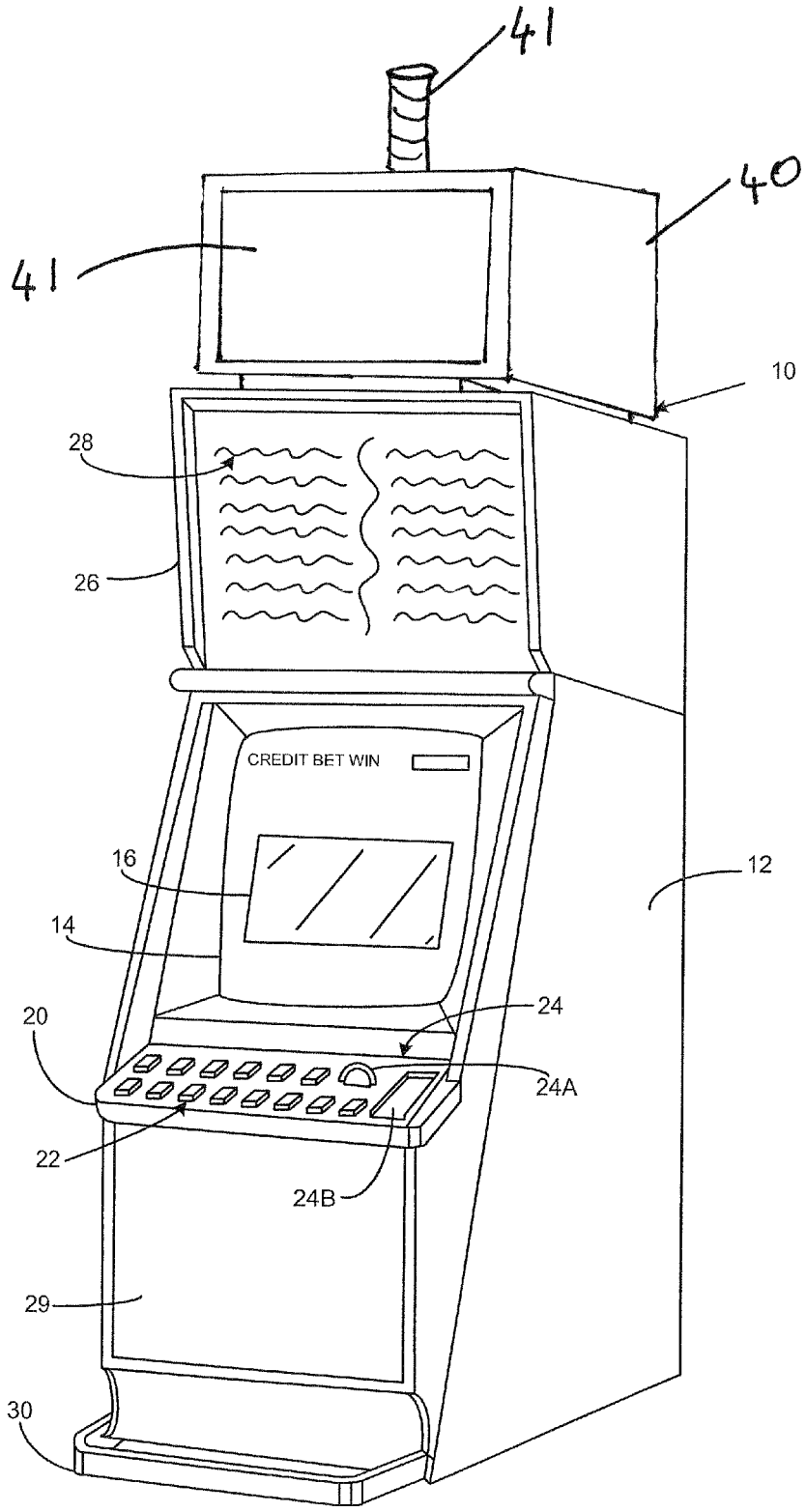
FIG. 2 is a perspective view of a stand alone gaming machine.

Together with the EGM of FIG. 2, the display apparatus 40 provides a gaming system. The gaming system can take a number of different forms. In a first form, a stand alone EGM as illustrated in FIG. 2 is provided, together with the display apparatus 40, wherein all or most components required for implementing a game are present in a player operable gaming machine (EGM).

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player. A display apparatus in accordance with an embodiment of the present invention may also be utilised with this form of architecture.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several components. At the broadest level, the components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54, a game play mechanism 56 that enables a player to input game play instructions (e.g. to place bets and make selections), and one or more speakers 58.

The game controller 60 is in data communication with the player interface 50 and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

In this embodiment, the game controller 60 may also include a wireless receiver/transmitter 66 which is arranged to communicate with a display apparatus 40 in accordance with an embodiment of the present invention.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

A display apparatus 40 in accordance with an embodiment of the present invention is mounted to the top of the stand alone gaming machine (or "EGM") together with a tower light 41 (sometimes referred to as a "candle") so as to define an active "topper" according to the various embodiments of the present invention.

Figure 3:
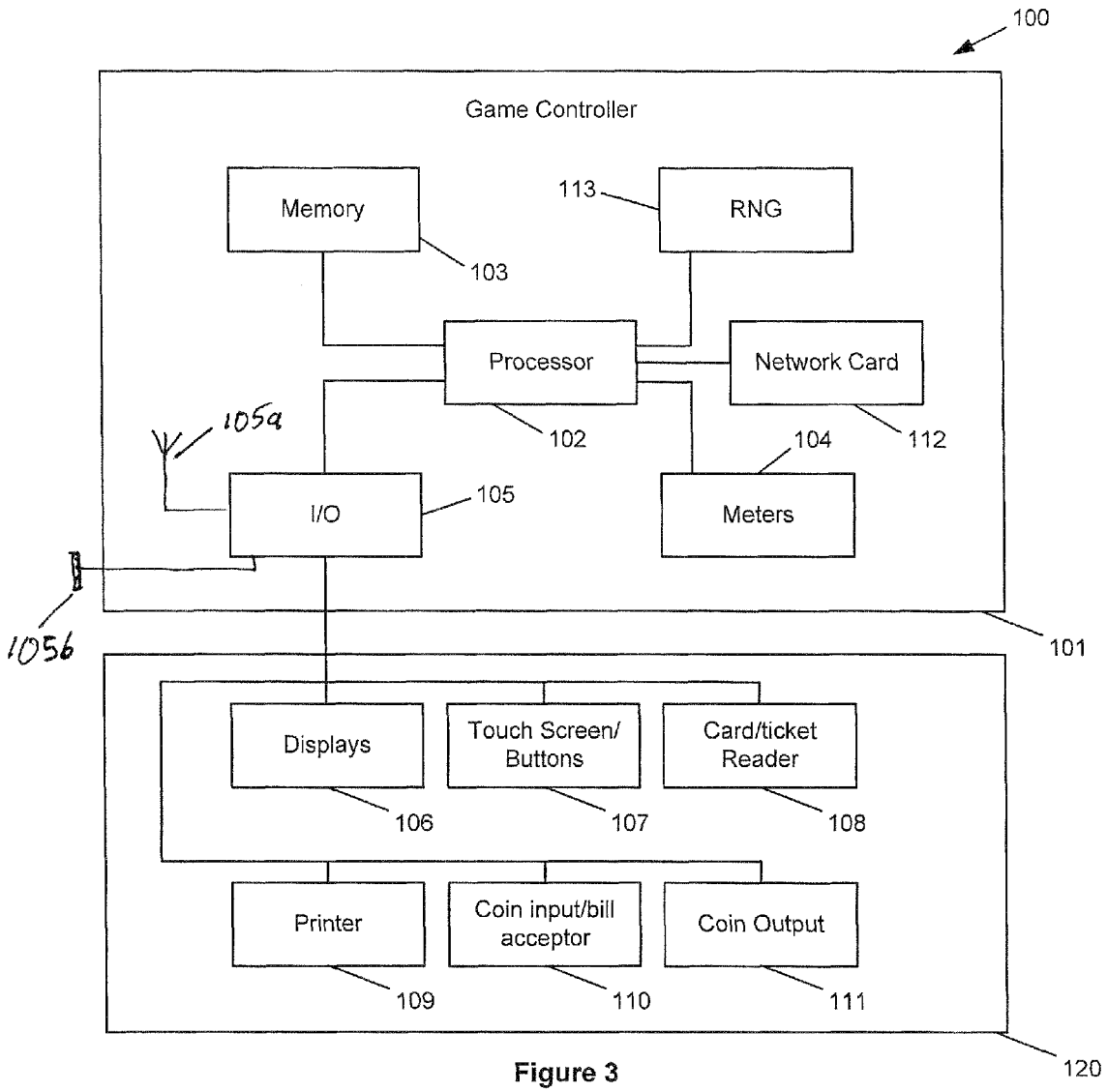
FIG. 3 is a block diagram of the functional components of a gaming machine and a display apparatus in accordance with an embodiment of the present invention.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. In this embodiment, the input/output interface 105 also includes a wireless communication facility 105*a*. This may be used to communicate with a display apparatus 40 in accordance with an embodiment of the present invention. Hardwired contacts are also shown schematically at 105*b* to provide an alternative communication channel to a display apparatus 40 in accordance with an embodiment of the present invention. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card 112 may, for example, send status information, accounting information or other information to a central controller, server or database and receive data or commands from the central controller, server or database.

Figure 4:
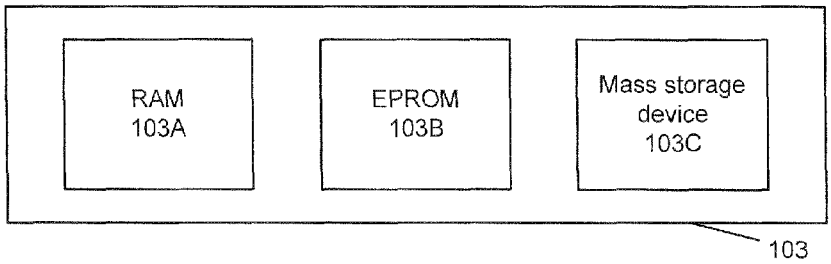
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
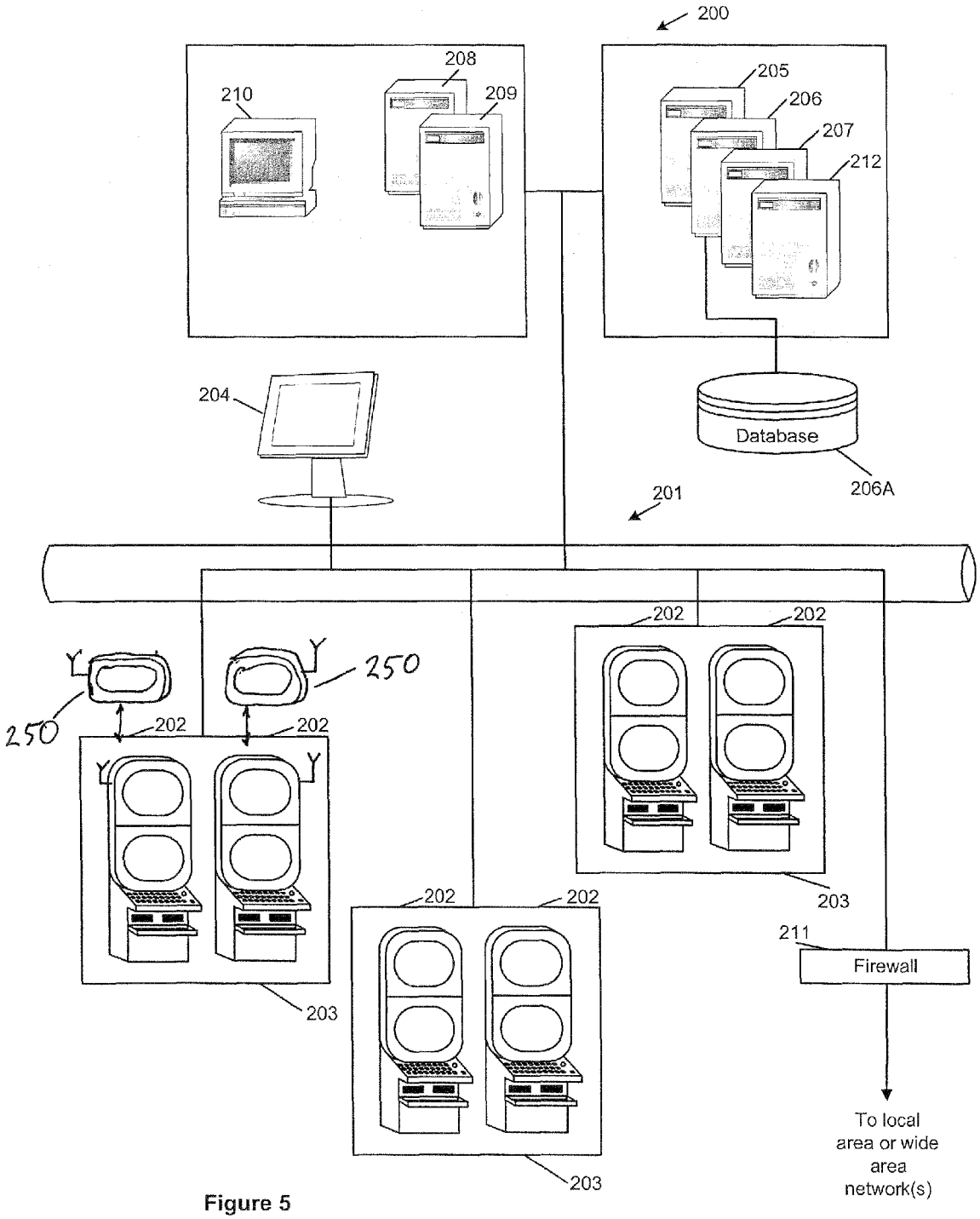
FIG. 5 is a schematic diagram of a network gaming system with a display apparatus in accordance with an embodiment of the present invention.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface (and in some cases graphics processing). With this embodiment, the game server 205 provides the game controller. The gaming machine 202 will receive player instructions, pass these to the game server 205 which will process them and return game play outcomes to the gaming machine 202 for display. In a thin client embodiment, the gaming machines 202 could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

Display apparatus 250 in accordance with an embodiment of the present invention may be associated with gaming machines 202 and/or displays 204 to provide further displays. In the embodiment illustrated in FIG. 5, the display apparatus 250 may be arranged to communicate wirelessly with gaming machines 202 and/or the network 201. The display apparatus 250 may display advertising materials unrelated to the game being played at the gaming machine 202, game attract mode displays to advertise the game being played, jackpot information or other video or graphics materials as desired. For example, for a bank of machines, the display apparatus 250 can be controlled (e.g. locally, via the network, or wirelessly) to display composite or sequential images to depict certain advertising or bonusing events, e.g. a trail travelling around the bank of machine display apparatus 250, from one to the other.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

As discussed above, FIG. 2 shows a representation of a display apparatus 40 in accordance with an embodiment of the present invention, which is arranged to be mounted to an EGM. The display apparatus 40 provides a display 41 which can be used in addition to the main display 16 (and also any secondary display in the top box 26) of the EGM 10. The display apparatus 40 may be controlled, in this example, by the EGM 10. It also may be controlled by an external device, such as a Casino server or jackpot controller (e.g. implemented by the jackpot server 207 shown in FIG. 5). Information relating to the EGM may be displayed by the apparatus 40 under the control of the EGM, or information required to be displayed on the apparatus 40 by the server or jackpot controller may be displayed.

A display apparatus 40 is in this case is in the form of a housing separate to the EGM 10 which mounts a display unit and display circuitry. The housing is arranged to be mounted to the EGM 12 by mounting apparatus, such as interfering mechanical arrangements, screws, nuts and bolts, or any other convenient fashion. In some embodiments, electrical or wireless connections may be made between EGMs circuitry and the display circuitry and/or between a network to an external device and the display circuitry of the display apparatus.

The display apparatus can take different outward forms. For example, FIG. 6, FIG. 7, FIGS. 9 and 10 show different types of EGMs, which may play different games. Although not described in detail here, they will have similar architectures to the EGM described with reference to FIG. 2. They may be programmed to play different games, may have different types of displays, etc, but generally their purpose is to play games for entertainment.

Figure 6:
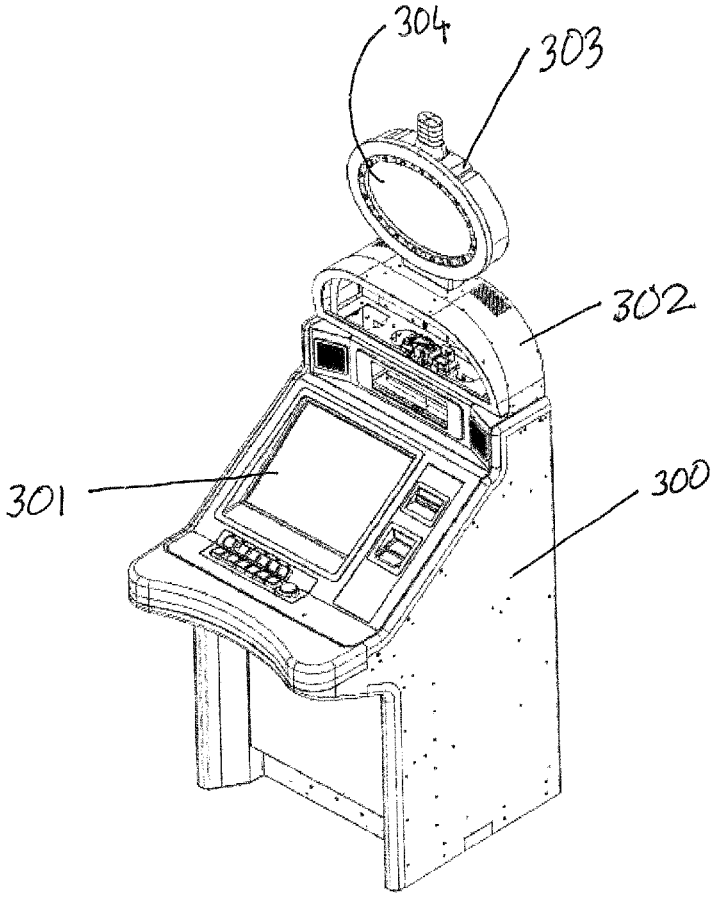
FIG. 6 is a perspective diagram from above and one side of a gaming machine and a display apparatus in accordance with a further embodiment of the present invention.
Figure 9:
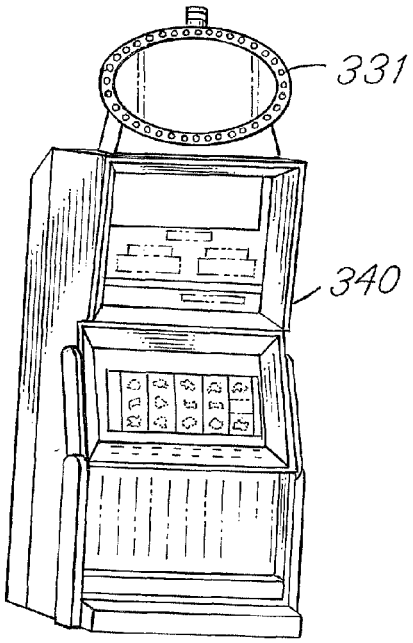
FIGS. 9 and 10 are perspective views of gaming machines with display apparatus in accordance with embodiments of the present invention.

Each of the EGMs in FIGS. 6, 7, 9 and 10 have a display apparatus in accordance with an embodiment of the present invention mounted thereto. Referring to FIG. 6, for example, the slant top EGM 300 is in this case provided with a primary video display 301 for playing a game where a plurality of symbol bearing reels are emulated by the video display 301. The player interface and components of the EGM 300 are similar to those described with reference to FIG. 2, although the external shape of the EGM 300 is different and it may be arranged to play a different game. Mounted to the top box 302 of the EGM 300 is a separate display apparatus 303 including a display screen 304 which in this case has been retro-fitted to the EGM. The display apparatus 303 comprises a display controller 402 which has been programmed to interface with a display controller of the EGM (e.g. using the same protocols, drivers, or any other necessary software/hardware). In this embodiment, the display apparatus 303 is oval in shape.

Figure 7:
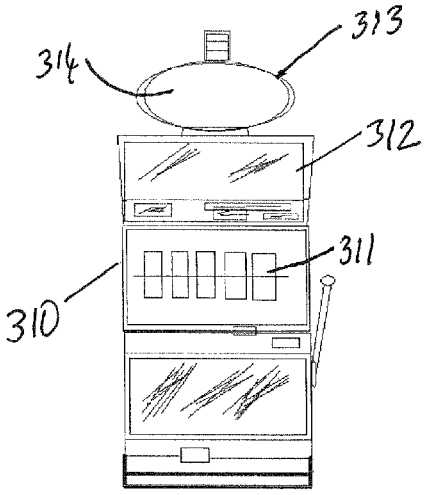
FIG. 7 is a front view of the gaming machine and the display apparatus in accordance with a further embodiment of the present invention.

Referring to FIG. 7, an EGM 310 of the form having actual reels 311 driven by stepper motors is illustrated. Attached to a top box 312 of the EGM 310 is a display apparatus 313 in accordance with an embodiment of the invention. This has a display 314 and is also generally oval in shape.

Figure 8:
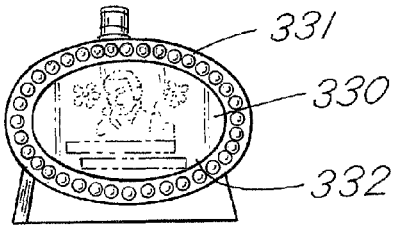
FIG. 8 is a front view of a display apparatus in accordance with an embodiment of the present invention.

FIG. 8 shows a display apparatus 330 in accordance with the present invention shown separate from the EGM. The housing 331 mounts display circuitry and a display 332. In this embodiment, the display apparatus 330 is shown displaying particular artwork for a particular game played on the type of EGM illustrated in FIG. 9 as EGM 340. The display 332 is a video display, and can therefore display any artwork in either static or dynamic forms under the control of the EGM 340 (in this embodiment). It will be understood by persons skilled in the art that the display apparatus 330 could advantageously be mounted to a different type of machine, playing a different game, and, under control of the controller of the EGM, display different artwork (and, indeed, any information that it is required to display).

Figure 10:
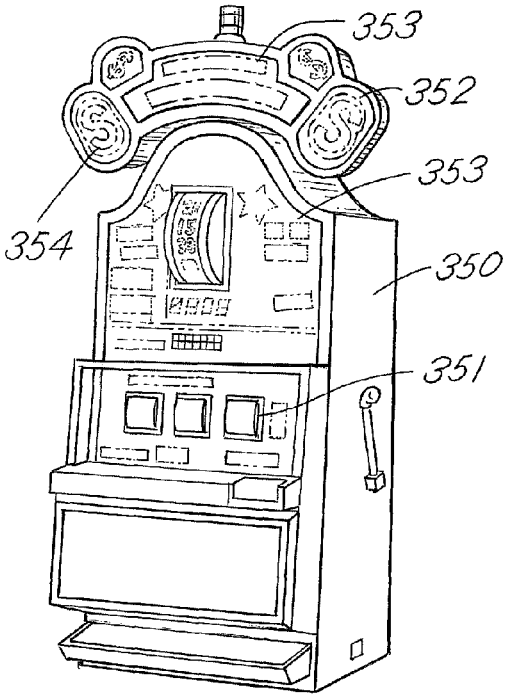

Referring to FIG. 10, a further type of EGM 350, again having stepper reels 351, is illustrated. A display apparatus 352 in accordance with an embodiment of the present invention, is mounted to the top box 353 of the EGM 350. The display apparatus 352 is of a different and "fancy" shape to that of the other illustrated embodiments. It includes a video display 353 and also artwork 354.

The display apparatus of embodiments of the present invention may be formed by any conveniently shaped housing. The housing may or may not include artwork, but will include a display, which may be a video display, which can be controlled by the EGM or another external device to display information as desired by the EGM or other external device.

Figure 11:
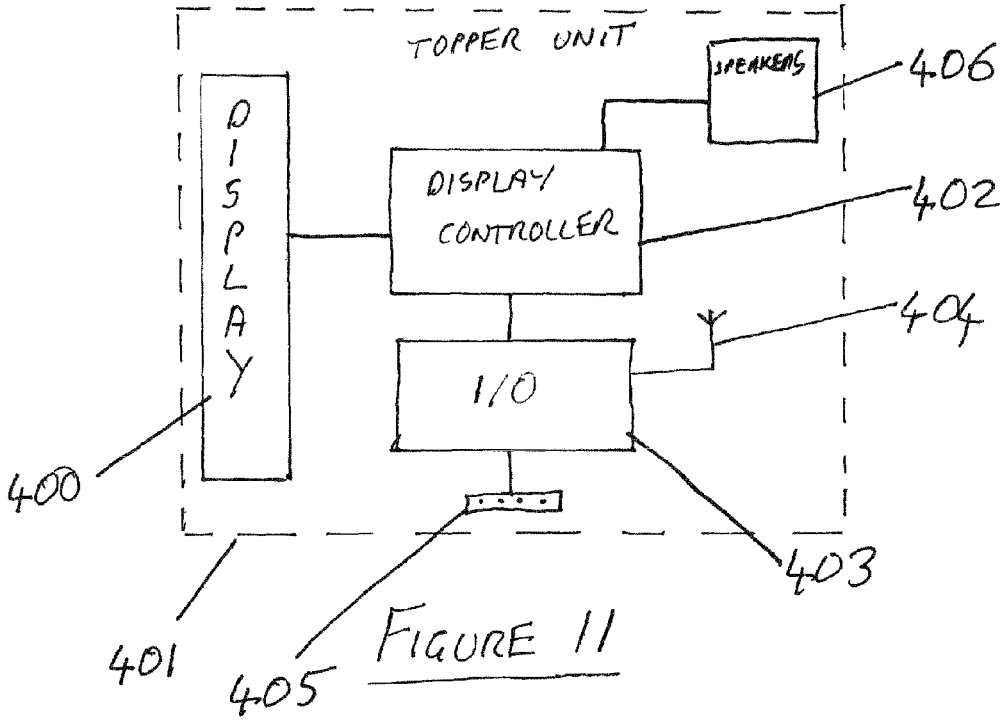
FIG. 11 is a block diagram of the functional components of a display apparatus in accordance with an embodiment of the present invention.

Referring to FIG. 11, a display apparatus 401 in accordance with the present invention, comprises a display 400, which in this example is a LCD (liquid crystal display). It may be any other type of display in other embodiments, however, such as vacuum fluorescent display (VFD), an LED display, plasma display or any other display of any shape or size.

The display apparatus 401 also comprises display circuitry, in this embodiment being in the form of a display controller 402 which includes a processor and associated memory for intelligently controlling the display apparatus 401. The display circuitry in this embodiment also includes an input/output interface 403 which includes a wireless communication facility 404 and also a hardwired connector 405 for connecting to external circuitry, such as contacts from an EGM or other external device. This embodiment therefore has the option of a hardwired connection or a wireless connection. The invention is not limited to this. Other embodiments may have hardwired or wireless connections, but not both. As previously mentioned, the controller 402 may be programmed with the necessary software and hardware to communicate with (and more particularly receive display instructions from) a device coupled to the apparatus by way of the input/output interface 403.

In this embodiment, speakers 406 for providing audio outputs are provided.

This embodiment is therefore an intelligent device 401 which can be selectively controlled by an EGM or other external devices to display information on a display 400 required by the EGM and/or other external devices.

Figure 12:
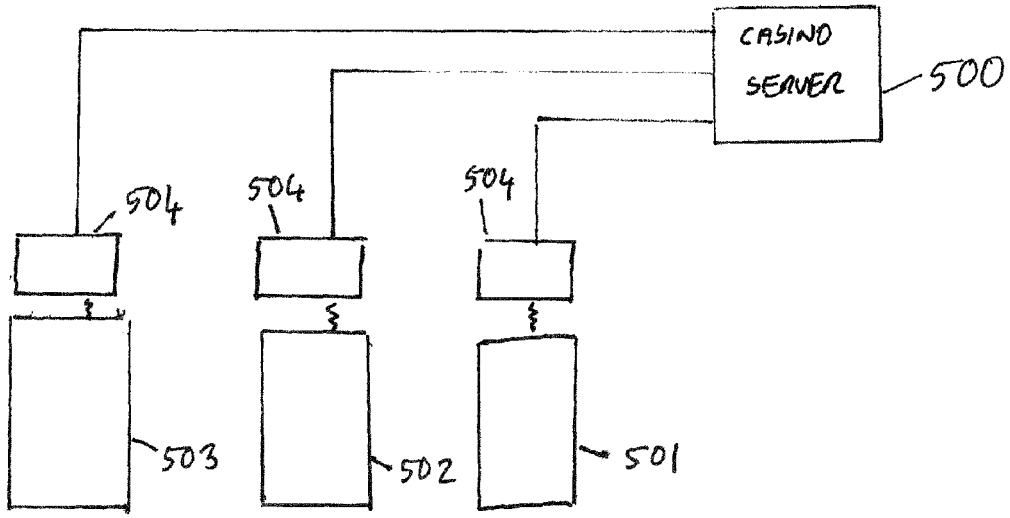
FIG. 12 is a schematic block diagram of a gaming system utilising display apparatus in accordance with an embodiment of the present invention.

FIG. 12 illustrates just one way in which a display apparatus in accordance with an embodiment of the present invention may be utilized. A plurality of different EGMs 501, 501 and 503, are each provided with a generic topper unit display apparatus 504, in accordance with an embodiment of the present invention. The display apparatus 504 includes a display and the other components described with reference to FIG. 11. In this embodiment, the topper display apparatus 504 may be controlled by the Casino server 500 which is hardwired (via contacts 405, for example) to communicate with the display controller 402 to control displayed information on the display apparatus 504, as desired by the Casino server 500. The topper display apparatus 504 is selectively connectable to the EGM 501, 502, 503 controller to display information under control of the EGM controller. It will be appreciated that many other ways of utilising the display arrangement are available. For example, referring to FIG. 5, display apparatus 250 in accordance with embodiments of the present invention may be used with a "downloadable" EGM, which is configured with software from a server to play different games, depending upon the software downloaded to it. Similarly, the display apparatus 250 may be driven to show different information depending upon the software downloaded to the configurable EGM 203.

As discussed above, the display apparatus can be driven/controlled by the EGM itself or any other external device. The display controller 402 communicates with the EGM's controller. In some embodiments it is also possible that the display may be controlled directly by the EGMs controller and/or external device. Connectivity is wired, wireless, or a combination of both, as discussed above.

Audio may be generated through the EGMs controller, or external device, or the topper unit 401 may have its own audio programmed in.

Advantages of using this type of intelligent display apparatus are many and it can have many applications. It may be used in an attract mode, for example, to attract players to the slot machine or EGM, to display Casino promotions, information on Casinos, games and other matters. It does all this without compromising any space within the EGM it is mounted to.

A topper unit may be utilised on a bank of several EGMs to display live synchronised video streams animations, graphics, synchronised with sound. It can also be used as a stand alone unit on a single EGM (as discussed above) and linked to the game as part of a game feature, or may be controlled independently of game theme.

Additionally, the topper unit may be used for community gaming, group gaming or peer to peer gaming to display video, animation and/or sound based on different game themes. It can also be controlled by a jackpot controller, for example, to display jackpot/progressive information as needed and/or to display bonusing features depending upon game themes.

As discussed above, the topper unit also can be used with configurable or downloadable EGMs. When the downloadable EGM is updated with a different gaming and/or theme the topper unit may be updated at the same time or controlled by the EGM to be updated, so that the topper can remain consistent with the EGM game/theme.

The display controller of the gaming apparatus may include software (stored in memory) configurable to enable it to communicate with EGMs of different types and/or external devices of different types.

In the above embodiment, the display apparatus includes a processor arranged to control the display apparatus. The invention is not limited to this. Other embodiments may include display circuitry enabling the display to be directly controlled by the EGM and/or external device.

Note that the term "electronic gaming machine" is not limited to machines which play reel-type games. Other games, such as roulette, Keno, bingo and many others may be played on EGMs and display apparatus of the present invention may be used with EGMs playing these types of games.

In the above embodiment, the display apparatus are removable and selectively mountable on different types of EGMs. In an alternative embodiment, the display apparatus may be non-removable and permanently attached to an EGM.

It will be appreciated that programme code may be necessary to some embodiments for, for example, enabling the display apparatus controller to communicate with the EGM and/or external device. Any programme code may be supplied in a number of ways. For example, on a computer readable medium, such as a disc or a memory, or as a data signal (for example, by downloading it from a server).

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A first electronic gaming machine (EGM) comprising:

a game controller for controlling play of one or more games on said first EGM;

a top box mounted to a first cabinet of said first EGM, and configured to display information or images relating to the one or more games;

a display apparatus mounted to said top box, said display apparatus comprising a housing configured to be removed from said top box and mounted to a second cabinet or a second top box of a second EGM;

a display disposed within said housing of said display apparatus; and a display controller within said housing of said display apparatus, such that said display controller is configured to be removed concurrently with said display apparatus from said top box and remains within said housing, said display apparatus comprising a processor and a memory, said display controller configured to:

communicate wirelessly with said game controller;

communicate wirelessly with a server to control said display to display live video streams; and communicate, based upon software instructions stored within and configurable from said memory for communicating with different types of electronic gaming machine controllers, with a plurality of different types electronic gaming machine controllers.

2. A first EGM in accordance with claim 1, wherein:

said display controller is further configured to change said display of said display apparatus in response to changed operation of said first EGM.

3. A first EGM in accordance with claim 1, wherein the server comprises a jackpot server, and wherein said display controller is further configured to be controlled by the jackpot server to cause said display to display jackpot information.

4. A first EGM in accordance with claim 1, wherein said display controller is further configured to be controlled by the server to display graphics synchronized among a plurality of display apparatus mounted to a plurality of EGMs, wherein the plurality of EGMs includes said first EGM and the second EGM.

5. A first EGM in accordance with claim 1, wherein said display controller is further configured to communicate wirelessly with a server to control said display to display at least one of advertisements, promotions, and bonusing events.

6. A method of conducting a game on a first electronic game machine (EGM), the method comprising:

providing, using a first EGM controller, the game on a game display of the first EGM;

controlling wirelessly, using the first EGM controller, a top box mounted to a first cabinet of the first EGM to display game-related information;

controlling wirelessly, using the first EGM controller, a display controller of a display apparatus to display game-related information, wherein the display apparatus is mounted to the top box, and wherein the display controller is configured to be removed concurrently with the display apparatus from the top box, and wherein the display controller is further configured to communicate with a second EGM controller based upon instructions for communicating with the second EGM controller stored in a computer memory, the second EGM controller different from the first EGM controller; and controlling wirelessly, using a server, the display controller of the display apparatus to display live video streams.

7. A method in accordance with claim 6 further comprising:

configuring the display controller of the display apparatus to be controlled by downloadable software for the first EGM, wherein the display apparatus displays information associated with the downloadable software.

* * * * *